United States Patent [19]

Howard

[11] 4,124,076

[45] Nov. 7, 1978

[54] FIRE EXTINGUISHER

[76] Inventor: Robert E. Howard, Springdale Lake, Belton, Mo. 64012

[21] Appl. No.: 825,674

[22] Filed: Aug. 18, 1977

[51] Int. Cl.[2] ..... A62C 11/00

[52] U.S. Cl. ..... 169/30; 222/394

[58] Field of Search ..... 169/30, 71, 72, 74, 169/76, 89; 239/323; 222/394

[56] References Cited

U.S. PATENT DOCUMENTS

| | | | |
|---|---|---|---|
| 2,239,816 | 4/1941 | Ensminger | 169/72 |
| 3,532,257 | 10/1970 | Olson et al. | 222/394 |
| 3,580,430 | 5/1971 | Riscle | 222/394 |

*Primary Examiner*—James B. Marbert

*Attorney, Agent, or Firm*—Schmidt, Johnson, Hovey & Williams

[57] ABSTRACT

A rechargeable dispensing apparatus, particularly suitable for use as a fire extinguisher, includes a generally spherical, enclosed dispensing container adapted to receive a liquid extinguishant therein, and has a flexible pickup tube shiftably confined therewithin which is provided with a weighted orifice for maintaining the latter at the bottom of the container below the level of remaining liquid within the container, whereby to allow continuous dispensing of the extinguishant in spite of tilting or turning of the apparatus by the user during the dispensing operation. A single, ordinary faucet-type valve, adapted to interchangeably couple with a filler pipe and a dispensing hose, provides the two-fold function of permitting introduction of liquid under pressure into the container and maintaining the same in a pressurized storage state, while also allowing the user to selectively release the liquid from the container through the dispensing hose, without the need for multiple, specially configured valve mechanisms.

6 Claims, 3 Drawing Figures

FIRE EXTINGUISHER

BACKGROUND AND BRIEF DESCRIPTION OF THE INVENTION

The present invention pertains to rechargeable dispensing apparatus, such as fire extinguishers, and deals more particularly with improvements in fire extinguishers of the type wherein the extinguishing liquid is stored and dispensed under its own pressure from an enclosed container.

Fire extinguishing apparatus which employ the pressure of the liquid applied to recharge the dispensing container for also pressurizing the latter to allow dispensing of the liquid under pressure are generally known in the art. The use of this type of apparatus is attractive because need for dedicated facilities for introducing a pressurizing medium, such as a gas, into the container in order to pressurize the extinguishing liquid, is eliminated. Heretofore however, fire extinguishers of the mentioned type have been rather complex in construction inasmuch as separate structure was required for the recharging and dispensing functions. For example, U.S. Pat. No. 3,351,105 to DiPerna discloses a rechargeable dispenser suitable for use as a fire extinguisher which requires a pair of valve mechanisms to respectively permit introduction of the liquid into the container, and dispensing of the liquid during use of the apparatus; an orifice specially configured to receive a filler pipe places a recharging source of liquid in communication with the interior of the container via a spring biased ball valve which is dipensed within the interior of the container. The DiPerna apparatus, however, is less than completely satisfactory in several respects; the ball valve mechanism is rather large, and being disposed within the container, displaces a volume of liquid therewithin, thus reducing the effective capacity of the container. Also, the ball valve is rather structurally complex and tends to be more vulnerable to the effects of wear with use, and deterioration, due to contact with the surrounding liquid. The structural arrangement shown by DiPerna requires that the apparatus be held in a specific position during use, so that the pickup tube within the container remains below the liquid level, whereby only the liquid, rather than the air compressed thereby, is allowed to escape; this limitation is particularly serious in connection with the use of the apparatus as a fire extinguisher, since persons untrained in the use and operation of such extinguishing apparatus, particularly in an emergency situation, may not appreciate that the apparatus must be held in a special position for operation.

Thus, there is a need in the art for a fire extinguisher apparatus which may be easily operated and recharged without special knowledge or skill on the part of the user, yet which is especially reliable in operation owing to simplicity of construction and the ability to pick up liquid within the container for dispensing thereof, regardless of the position in which the apparatus is held by the user.

According to the present invention, a generally spherical, pressure-tight container includes an orifice in communication with a single faucet-type assembly which is adapted to interchangeably couple with a filler pipe such as an ordinary garden hose, or a flexible dispensing hose and nozzle combination. The container may be simply recharged by coupling the filler pipe to the faucet assembly and manually opening the faucet valve, whereupon the source of extinguishing liquid is placed in communication with the interior of the container and flows into the latter until pressure equalization occurs, at which time the valve may be closed to retain the confined liquid in a pressurized condition within the container. The filler pipe is then replaced with the dispensing hose, and a user may proceed to operate the apparatus by opening the faucet valve and directing the ensuing outflow of liquid using the dispensing hose and nozzle. A flexible pickup tube coupled with the faucet assembly is moveably trained within the container and has the free open end thereof weighted to be readily shifted, under the influence of gravity along with any remaining liquid within the container, whereby to always assume a pickup position beneath the liquid level, regardless of the position which the user holds the apparatus.

Accordingly, it is a primary object of the invention to provide a rechargeable, liquid dispensing apparatus having a manually operable valve assembly in communication with a pressure-tight liquid container for allowing introduction of liquid into the container to recharge the apparatus, and for rendering the apparatus operable to dispense liquid contained under pressure therewithin. As a corollary to the foregoing object, it is a further object to provide a single, especially simple valve assembly which is adapted to interchangeably couple with a filler pipe for recharging the apparatus, and with a hose member for dispensing the liquid during use.

Another object of the invention is to provide a dispensing apparatus which reliably and consistantly dispenses liquid from container associated therewith, regardless of the position in which the container is disposed. In connection with the foregoing object, it is a further object to provide dispensing apparatus of the mentioned type having a spherically shaped liquid container provided with a flexible pickup tube moveably disposed therewithin which is adapted to follow the contour of the container as the latter is shifted in position, whereby the pickup tube remains below the level of the liquid to assure that the remaining liquid, rather than pressurizing gas, is dispensed.

A further object of the invention is to provide liquid dispensing apparatus in which valve means for operating the apparatus are disposed exterior of the liquid container whereby to maximumize the volume of liquid which may be stored and dispensed.

Other and further objects of the invention will be made clear or become apparent in the course of the following description of a preferred embodiment of the invention.

DETAILED DESCRIPTION OF THE INVENTION

Figure 2:
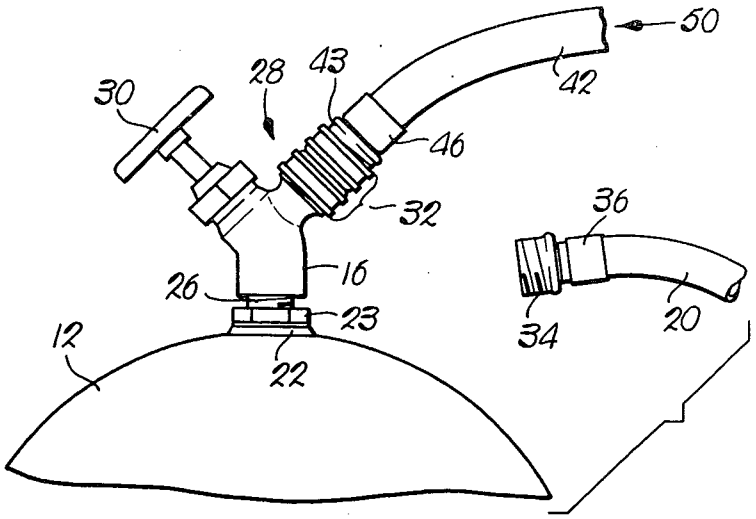
FIG. 2 is a fragmentary view of the preferred embodiment, showing a faucet valve assembly having a filler pipe coupled thereto, and further showing a dispensing hose which may be interchangeably coupled with the faucet valve assembly.
Figure 3:
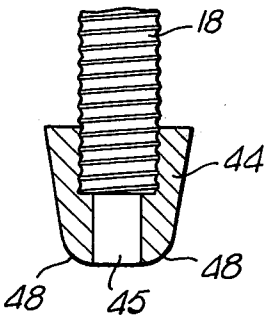
FIG. 3 is a fragmentary view of the free extremity of a liquid pickup tube with a weight means associated therewith being shown in cross-section.

Referring now to the drawings, a liquid dispensing apparatus broadly designated by the numeral 10 includes a liquid container 12 supported by a base 14, and is further provided with a valve assembly 16, a liquid pickup tube 18, and a dispensing hose 20.

Figure 1:
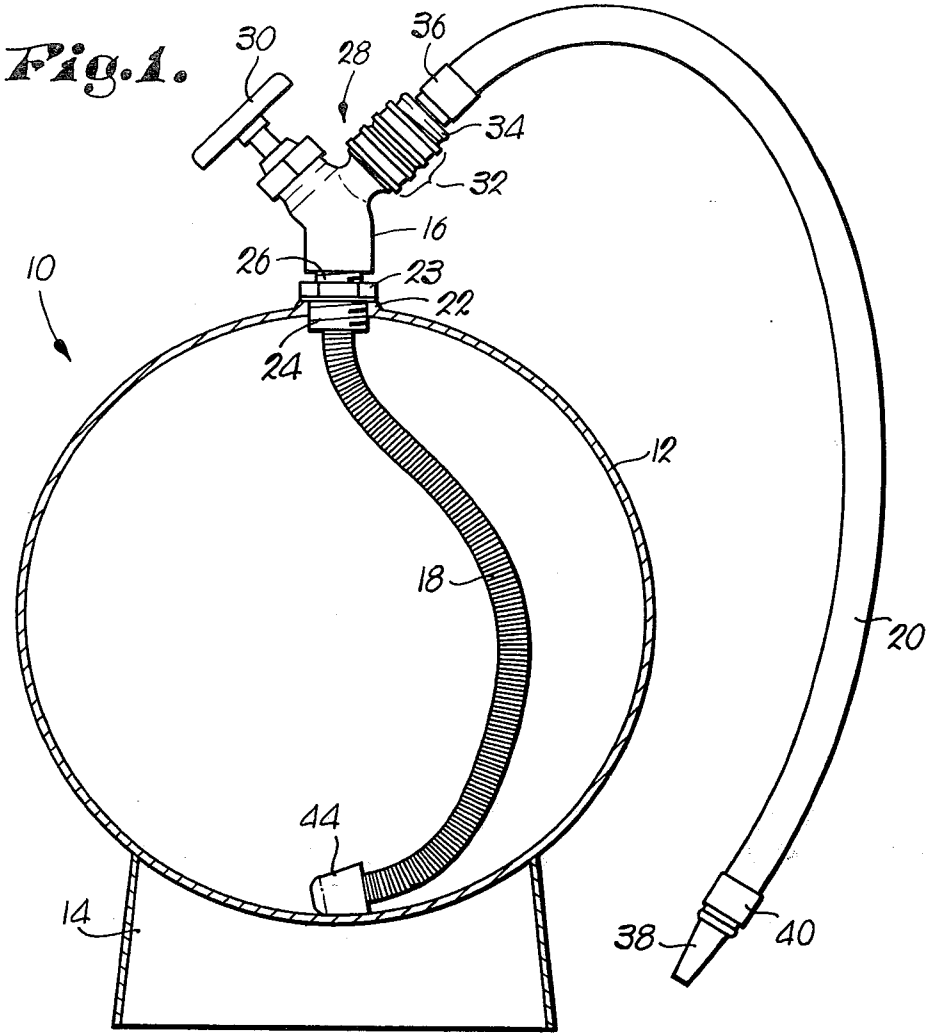
FIG. 1 is a cross-sectional side view of the liquid dispensing apparatus which forms the preferred embodiment of the present invention.

Container 12 is significantly formed in the general shape of a sphere and provides a sealed, pressure-tight enclosure for storing a quantity of liquid therewithin under pressure. The container 12 may be manufactured from any suitable material, such as aluminum, plastic, fiberglass or stainless steel, which provides the necessary structural rigidity, and has base 14 suitably joined to the bottom thereof for stationarily supporting the apparatus 10. The container 12 has a single circular outlet orifice therein, near the apex thereof, provided with annular upstanding shoulder area 22 which seatably engages a flanged portion 23 of tubular bushing 24, which bushing is secured fast to the container 12 within the orifice of a latter, by an appropriate means. Bushing 24 has interior surfaces thereof threaded to receive the male threaded nipple 26 of valve assembly 16. Valve assembly 16 comprises a faucet-type screw valve of the well known type having inlets defined by nipple 26 and leg 28, which inlets are selectively placed in communication with each other by means of the manually operable valve control 30. Leg 28 will typically include a male threaded nipple (not shown) which is threadably received by one end of a common, double female threaded coupling 32. As shown in FIG. 1, the other end of double coupling 32 threadably receives the male coupling 34 which latter coupling is secured to the flexible dispensing hose 20 by means of an ordinary hose clamp 36. A nozzle 38 may be fastened to the free end of hose 20 by clamp 40. As shown in FIG. 2, the hose 20 may be simply disconnected from the apparatus 10 by unscrewing coupling 34, and a filler pipe 42 secured to male coupling 43 by clamp 46, may then be connected to the apparatus 10 by screwing the male coupling 43 into the free female portion of coupling 32.

The pickup tube 18 is of a length marginally longer than the diameter of container 12 and has one end thereof secured to either bushing 24 or nipple 26 in an air sealed fashion such that any gas within the container is prevented from entering the pickup tube 18 or the inlets of the valve assembly 16. The pickup tube 18 is preferably constructed of a highly flexible material, herein shown as a relatively thin plastic-like material overlaying a spiral metal supporting wire which forms a plurality of rib-like articulations that provide a readily flexing, but air-tight, conduit means. Weight means 44, constructed of lead or any similar heavy material, is secured to the free movable end of pickup tube 18 and has the longitudinal axis thereof generally aligned with the like axis of pickup tube 18. Weight means 44 has an annular passageway 45 therethrough placing the interior of the pickup tube 18 in communication with the interior of the container 12, and includes a annular rounded edge 48 on the outer extremity thereof, for reasons which will become later apparent. From the foregoing description then, it is apparent that the interior of the container 12 is selectively placed in liquid flowing communication with either dispensing hose 20 or filler pipe 42 by means of a single, faucet-type valve assembly 16.

In operation, the apparatus 10 can be put into use, or recharged, in an especially simple manner. Assuming that the container 12 has a sufficient quantity of liquid already stored under pressure therewithin, the user may transport the apparatus 10 to the location of intended use and initiate the dispensing operation by merely turning "on" the valve control handle 30, to place the dispensing hose 20 in liquid flow communication with the pickup tube 18, whereupon liquid within the container 12 is forced under pressure to flow through the pickup tube 18, valve assembly 16, hose 20, and the liquid is finally dispensed from the nozzle 38. During the dispensing operation, weight means 44 is urged by gravity to remain at the lowest point or "bottom" of the container 12, and therefor beneath the level of any remaining liquid therewithin. In the event that the position of the apparatus 10 is shifted during use thereof, the weight means 44 readily slides over, and is guided by, the interior curved wall portions of the container 12, along with any liquid therewithin, and thus always maintains the inlet of the free outer end of pickup tube 18 below the liquid level. The rounded edge 48 prevents weight means 44 from "standing on end" such that the passageway 45 seats against the interior wall of the container 12 to block pickup of the liquid.

In order to recharge the apparatus 10, the hose 20 is disconnected by unscrewing its associated coupling 34 from the double coupling 32, and a filler pipe 42, such as an ordinary garden hose, is similarly connected to the valve assembly 16 as shown in FIG. 2. With the filler pipe 42 thusly connected, the valve control handle 30 may be operated to open the valve assembly 16 whereby liquid flowing under pressure in the direction of the arrow 50 through the pipe 42, flows through the valve assembly 16, pickup tube 18, and into the container 12 thereby replenishing the latter. When pressure within the container 12 (which tends to urge the liquid to reverse its flow direction) essentially equals the pressure forcing the liquid through the pipe 42 into the container 12, the control valve handle 30 may be operated to close the valve assembly 16 to maintain the liquid within the container 12 in a pressurized state for future use. The filler pipe 42 may then be disconnected and the dispensing hose 20 is reconnected to the apparatus, thereby readying the apparatus 10 for use.

From the foregoing, it is apparent that the invention provides an especially simple liquid dispensing device, particularly suitable for use as a fire extinguisher, which employs a single, faucet-type valve to allow both recharging of th apparatus as well as selected dispensing therefrom, while also providing apparatus of the mentioned type which may be held in any position during use thereof without affecting the reliability of operation of the apparatus. Thus, it will be observed that my improved fire extinguishing apparatus not only provides for the reliable accomplishment of the objects of the invention, but does so in a particularly simple and economical manner. It is recognized, of course that those skilled in the art may make various modification or additions to the preferred embodiment chosen to illustrate the invention without departing from the jest and essence of my contribution to the art. Accordingly, it is to be understood that the protection sought and to be afforded hereby should be deemed to extend to the subject matter claimed and all equivalence thereof fairly within the scope of the invention.

Having thus described the invention, what is claimed as new and desired to be secured by Letters Patent is:

1. A rechargeable fire extinguishing apparatus, comprising:

a closed dispensing container including an outlet therein, and being adapted to store a flowable fire extinguishant under pressure therein;

a valve member operably connected with said outlet for both selectively controlling the flow of said extinguishant out of said container through said outlet of the latter whereby to dispense said extinguishant, and for selectively controlling the flow of said extinguishant from a recharging source of the latter into said container through said outlet therein whereby to recharge said apparatus;

nozzle means for directing the flow of said extinguishant as the latter is dispensed from said apparatus to extinguish a fire; and means connected with said valve member for releasably coupling said nozzle means with said outlet through said valve means to allow dispensing of said extinguishant from said apparatus, said coupling means being also adapted for releasably coupling said recharging source of extinguishant with said outlet through said valve means to allow recharging of said apparatus when said nozzle means is uncoupled from said apparatus.

2. The invention of claim 1, wherein said container includes generally spherically shaped interior wall portions, said apparatus further including conduit means for placing said container outlet in communication with said extinguishant within said container, said conduit comprising:

an elongate tube member having one extremity thereof operably connected with the combination of said outlet and said valve means, and further having a length at least as great as the diameter of said interior wall portions of said container, at least a stretch of said tube member being readily flexible whereby to render the other extremity of said tube member freely shiftable within said container, said shiftable extremity cooperating with said interior wall portions for slidably engaging the latter, said shiftable extremity, being guided by the contour of said wall portions during shifting of said shiftable extremity produced by gravity, whereby to maintain said shiftable extremity below the level of said extinguishant within said container when the latter's position is shifted.

3. The invention of claim 2, wherein essentially the entire length of said tube member is readily flexible and there is further provided:

weight means attached to said shiftable extremity of said tube member, said weight means having a mass sufficiently attracted by gravity to urge said shiftable extremity to shift its position when the position of said apparatus is shifted.

4. The invention of claim 3, wherein:

said weight means substantially circumscribes the circumference of said shiftable extremity of said tube member and includes a passageway therethrough terminating in an orifice for placing the interior of said tube member in communication with the interior of said container, said weight means including exterior surface portions extending generally parallel with the longitudinal axis of said tube member and adapted to sligably engage said interior wall portions.

5. The invention of claim 2, wherein:

said valve member includes first and second inlets thereto respectively coupled with said container outlet and said releasable coupling means, said valve member further including a manually operable control element operative to selectively place said inlets in communication with each other, there being further provided a flexible hose member operably coupled between said releasable coupling means and said nozzle means to allow the latter to be selectively aimed during the dispensing of said extinguishant, and structure for supporting said dispensing container on a base surface.

6. The invention of claim 5, wherein:

one of said valve member inlets associated with said releasable coupling means comprises a threaded male element, and said releasable coupling means comprises a first, threaded female coupling for receiving said male element of said valve member, and a second, threaded female coupling adapted to receive a threaded male element associated with said hose member.

* * * * *